US007234325B2

(12) United States Patent
McAllister et al.

(10) Patent No.: US 7,234,325 B2
(45) Date of Patent: Jun. 26, 2007

(54) TIME-VARYING AGITATOR OSCILLATIONS IN AN AUTOMATIC WASHER

(75) Inventors: K. David McAllister, St. Joseph, MI (US); Carrie Ann Dickinson, St. Joseph, MI (US); Duane M. Kobos, LaPorte, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/533,801

(22) Filed: Sep. 21, 2006

(65) Prior Publication Data

US 2007/0017262 A1 Jan. 25, 2007

Related U.S. Application Data

(62) Division of application No. 10/142,345, filed on May 9, 2002, now Pat. No. 7,127,767.

(51) Int. Cl.
*D06F 33/00* (2006.01)
*D06F 21/00* (2006.01)

(52) U.S. Cl. ..... 68/23.7; 68/133

(58) Field of Classification Search ..... 68/12.02, 68/12.16, 23.7, 131–133
See application file for complete search history.

(56) References Cited

U.S. PATENT DOCUMENTS

| | | | | |
|---|---|---|---|---|
| 5,315,847 | A * | 5/1994 | Takeda et al. | 68/12.02 |
| 6,212,722 | B1 * | 4/2001 | Pinkowski et al. | 8/158 |
| 6,269,666 | B1 * | 8/2001 | Whah et al. | 68/12.02 |
| 7,062,810 | B2 * | 6/2006 | Hardaway et al. | 8/159 |
| 2003/0035757 | A1 * | 2/2003 | Cooremans et al. | 422/82.05 |
| 2005/0160536 | A1 * | 7/2005 | McAllister et al. | 8/137 |

* cited by examiner

*Primary Examiner*—Joseph L. Perrin
(74) *Attorney, Agent, or Firm*—Clifton Green; Michael D. Lafrenz

(57) ABSTRACT

Methods and apparatuses consistent with the present invention provide for improved clothes rollover in automatic washer cycles using time-varying rotor oscillations. An automatic washer has a wash chamber with a central axis and a rotor being rotatable about the central axis. Items are loaded into the wash chamber. Wash liquid is supplied into the wash chamber. The rotor is oscillated about the central axis by time-varying oscillations.

20 Claims, 11 Drawing Sheets

TIME-VARYING AGITATOR OSCILLATIONS IN AN AUTOMATIC WASHER

CROSS-REFERENCE TO RELATED APPLICATION

This application is a divisional of U.S. application Ser. No. 10/142,345, filed May 9, 2002 now U.S. Pat. No. 7,127,767, this application hereby incorporated by reference.

BACKGROUND OF THE INVENTION

1. Field of the Invention

The present invention relates to washing machines and more particularly to moving clothes within the wash chamber of an automatic washer.

2. Description of the Related Art

Known washing machines include agitator washing machines and impeller washing machines. Agitator washing machines use a water bath, in conjunction with clockwise and counter-clockwise agitator oscillations, to promote mechanical action inside a wash basket. In general, these machines tend to move a clothes load down through the center of the wash basket, generally parallel to the centerline of the agitator, then radially outward along the wash basket bottom, then upward and generally parallel to the sides of the wash basket, and then inward across the top of the water bath.

Impeller washing machines generally move the clothes in a rotating vortex-like motion that is centered about the impeller axis. This vortex washing motion often results in the tangling of clothes into rope-like masses. Tangled clothes do not wash well, may transfer dyes between clothes, and may have more wrinkles than untangled clothes when dried.

In typical washing machines, both impeller and agitator oscillations are symmetric and constant during the majority of a wash cycle. FIG. 1 depicts a typical symmetrical agitator or impeller oscillation period during a typical wash cycle. In FIG. 1, signals above the horizontal time axis indicate a clockwise rotation signal, signals along the time axis indicate no rotation signal (motor off) or a pause, and signals below the time axis indicate a counter-clockwise rotation signal. The illustrated oscillation period includes a 0.5 second clockwise (motor on) time, followed by a 0.5 second pause (motor off), followed by a reversing 0.5 second counter-clockwise (motor on) time, followed by a 0.5 second pause (motor off). The oscillations are constant, in that the period is then repeated, as illustrated in FIG. 1. In some agitator washing machines, the oscillations are achieved with a fixed-speed motor and a mechanical, reversing transmission. Other agitator washing machines use a reversing motor and electronic switching controls.

The oscillation patterns can also be more complex. This complexity can take several forms. One form observed in typical impeller machines is that longer oscillation periods are used, e.g., 8 seconds clockwise (motor on), 8 seconds pause (motor off), 8 seconds counter-clockwise (motor on), 8 seconds pause (motor off). Another typical form of complexity is that, within an oscillation period, non-symmetric motor profiles can be used, e.g., 8 seconds clockwise (motor on), 2 seconds pause (motor off), 8 seconds counter-clockwise (motor on), 2 seconds pause (motor off). The relatively higher value of motor on times in both of these typical patterns results in the disadvantage of severe clothes tangling. These higher motor on time values, however, are common to the washing machine industry.

One additional known form of complexity is observed in agitator washers. Some washer models change to an increased-time period for the symmetric oscillations near the end of the wash cycle. For example, a washer may have a 0.5-second on/pause/on/pause oscillation pattern for 11 minutes of washing, then change to a 0.8 second on/pause/on/pause oscillation pattern for the last minute of the wash cycle. This change is performed in an attempt to reduce tangling of the clothes load and to distribute the clothes load evenly in the basket prior to spin and water extraction. The evenly distributed clothes have a reduced tendency to cause an off-balance condition during the spin. In some agitator washers, however, this change in the cycle requires the use of a multi-speed motor and a reversing transmission. The higher cost of the multi-speed motor represents a disadvantage.

Engineering efforts to reduce water usage in impeller machines resulted in the discovery of the inverse toroidal motion (LaBelle, et al., U.S. Pat. No. 6,520,396). An inverse toroidal motion washing machine uses an impeller plate with a reduced water amount. The clothes load in this washing machine moves radially inward across the impeller plate, up through the center of the wash basket, then radially outward along the top of the water bath, then downward and generally parallel to the sides of the wash basket. This clothes motion, or rollover, typically occurs with an approximately 0.5-second symmetric and constant impeller oscillation pattern, as depicted in FIG. 1. With this clothes motion and oscillation pattern, however, two problems exist.

First, when using symmetrical impeller oscillations, larger wash loads tend to be less inclined to begin the inverse toroidal roll and are more "lethargic" in their motion than smaller clothes loads. Reduced rollover is often associated with poor wash performance on soils like carbon that require mechanical action. Second, when using symmetrical impeller oscillations with small to medium-sized loads, the uniformity of the load within the wash basket is not assured. This non-uniformity can lead to an off-balance condition during basket spin.

The non-uniformity of the load problem is specifically observed in low-water impeller machines, and appears to be related to higher oscillation cycle times. This problem has been called "bunch and slosh". "Bunch and slosh" is a term used by one of skill in the art to describe clothes load distribution about the wash basket diameter during low-water levels. At certain times during the wash cycle, a majority of the clothes load can be observed from the top of the washer as being gathered into one quadrant of the wash basket (i.e., a "bunch"), leaving a minority of the load in the remaining quadrants. The quadrants with the minority of the clothes have a higher water-to-clothes ratio, and often these areas contain only water (i.e., they create a "slosh" sound). This non-uniform configuration inside the wash basket is undesirable for several reasons. First, it can result in an off-balance situation during wash basket spin, if the non-uniformity exists at the end of the wash cycle. Second, the tightly packed "bunch" of clothes does not expose the center of the "bunch" to the mechanical action of cloth-to-cloth motion and the mechanical action of cloth-to-impeller motion. This lack of mechanical action, which is needed to remove certain soils from the clothes, can limit the performance of low-water impeller machines. Third, it has been observed that the typical inverse toroidal motion tangles clothes loads less than does the action of a deep-water impeller wash, however, this reduced-tangle advantage is not achieved when the "bunching" of the load occurs. This is because the load movements that create "bunching" (i.e., move the clothes load to a concentrated mass in the basket) are different than the load movements that give rise to inverse toroidal roll (i.e., move the load radially and uniformly inward). In summary, "bunching" appears to preclude uniform inverse toroidal rolling.

Based on the above-described problems of washing machines, it is therefore desirable to improve them.

SUMMARY OF THE INVENTION

According to the present invention, therefore, methods and apparatuses are provided for enhancing the mechanical action inside a washing machine having an impeller, agitator, horizontal axis drum, or tilted axis drum design by using symmetric clockwise and counter-clockwise impeller, agitator, horizontal axis drum, or tilted axis drum oscillations that vary randomly with each subsequent period. These oscillations reduce the tendency for non-uniformity and "bunch and slosh" in low-water impeller systems, promoting both reduced tangling and providing strong washing motion in all load sizes. These oscillations that vary randomly with each subsequent period are referred to as "random strokes" herein. Further, in an embodiment, the variation of the oscillations can be limited to two selected period lengths, switching between these two lengths after every third period. This variation is referred to as "bi-modal" herein.

In accordance with methods consistent with the present invention, a method of washing items in an automatic washer is provided, wherein the automatic washer has a wash chamber with a central axis and a rotor being rotatable about the central axis. The method comprises the steps of loading items into the wash chamber, supplying wash liquid into the wash chamber, and oscillating the rotor about the central axis by time-varying oscillations. The rotor can be an agitator, impeller, horizontal axis drum, or tilted axis drum design.

In an embodiment, the rotor oscillates for a plurality of periods of clockwise and counter-clockwise oscillations, wherein the time duration of the oscillations are selected for each period. A period comprises at least one clockwise oscillation and at least one counter-clockwise oscillation. The oscillations can be symmetrical or asymmetrical, and can have a time duration that is variable. Further, in another embodiment, the time duration of the oscillations vary for consecutive periods. The average mean time of the time-varying oscillations can be adjusted by the controller responsive to an amount of the items or to a size of the items.

The items in the wash chamber can move, for example, in a toroidal wash pattern or an inverse toroidal wash pattern.

In accordance with apparatuses consistent with the present invention, an automatic washer is provided. The automatic washer comprises a cabinet, a wash chamber with a central axis supported within the cabinet, a motor suspended outside the wash chamber, and a rotor disposed in the wash chamber and drivingly connected to the motor, the rotor oscillating about the central axis by time-varying oscillations.

The above-mentioned and other features, utilities, and advantages of the invention will become apparent from the following detailed description of the preferred embodiments of the invention together with the accompanying drawings.

Other systems, methods, features, and advantages of the invention will become apparent to one with skill in the art upon examination of the following figures and detailed description. It is intended that all such additional systems, methods, features, and advantages be included within this description, be within the scope of the invention, and be protected by the accompanying drawings.

BRIEF DESCRIPTION OF THE DRAWINGS

The accompanying drawings, which are incorporated in and constitute a part of this specification, illustrate an implementation of the invention and, together with the description, serve to explain the advantages and principles of the invention.

DETAILED DESCRIPTION OF THE INVENTION

In accordance with methods and apparatuses consistent with the present invention, the mechanical action inside a washing machine having an impeller or agitator design is enhanced by using symmetric clockwise and counter-clockwise impeller or agitator oscillations that vary randomly with each subsequent period.

Methods and apparatuses consistent with the present invention may be embodied in any type of automatic washer, as well as any type other oscillating systems within appliances. The present invention may be embodied, for example, in a vertical axis washer, as disclosed in U.S. Pat. No. 6,212,722, which is incorporated herein by reference. The automatic washer disclosed in U.S. Pat. No. 6,212,722 is a vertical axis washer having an impeller that provides inverse toroidal rollover of a clothes load. The present invention, however, is not limited thereto, and may be embodied in, for example, a horizontal axis washer or tilted axis washer.

Figure 1:
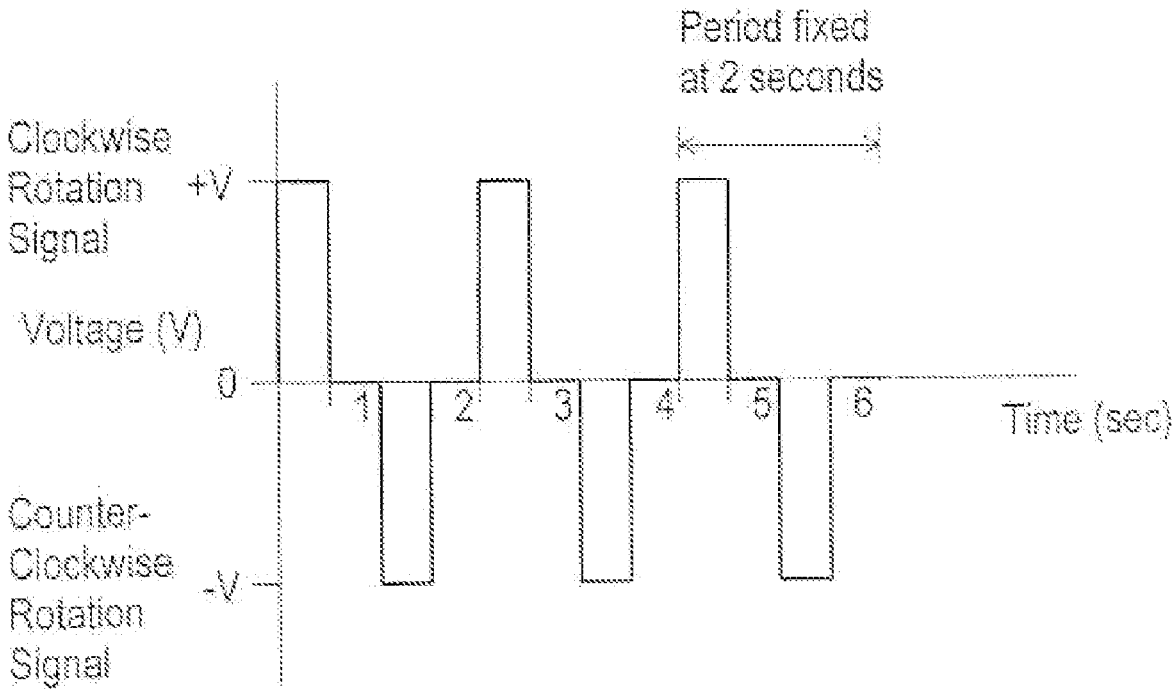
FIG. 1 depicts a timing diagram of typical symmetrical motor oscillations that are constant for all periods.
Figure 2:
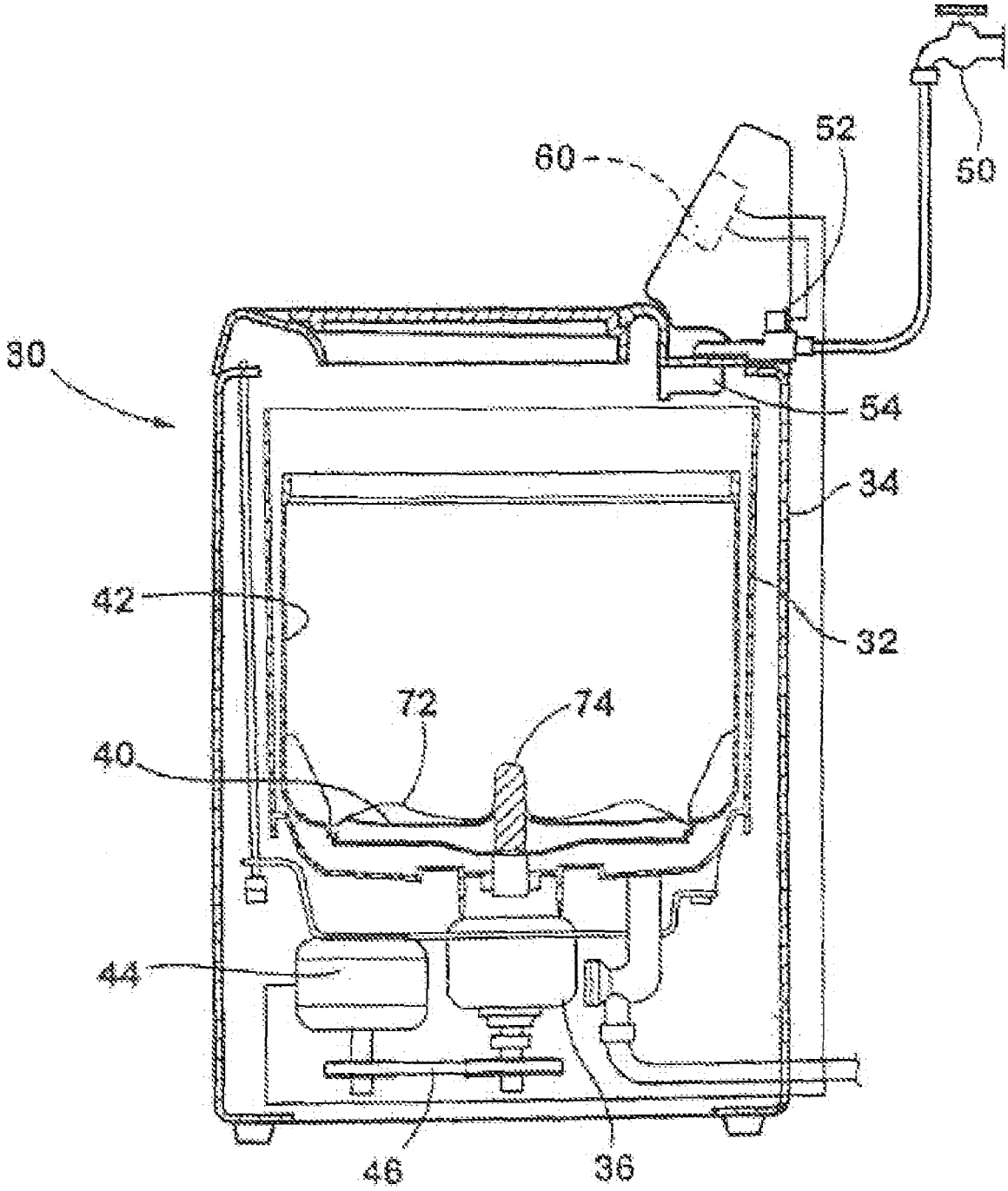
FIG. 2 depicts a side sectional view of a washing machine constructed and operated in accordance with the present invention.

In an example, methods and apparatuses consistent with the present invention may be embodied, for example, in an automatic washer as depicted in FIG. 2. FIG. 2 illustrates an automatic washer 30 having an outer tub 32, which is disposed and supported within a cabinet structure 34. A power transmission device 36 is provided below the tub for rotatably driving a rotor, e.g., an impeller 40, and a wash basket 42. The impeller 40 can comprise a plurality of ribs or protrusions 72. Moreover, the impeller 40 can be designed to avoid what may be referred to as center clogging. Center clogging occurs when the cloth items being pushed upwardly along the center axis of the impeller 40 are impeded in a manner which slows or prevents inverse toroidal rollover motion. To avoid center clogging, the impeller 40 may be provided with a raised center 74. The wash basket 42 is rotatably supported within the tub 32. Drive power is transmitted from a reversing or unidirectional motor 44 to the power transmission device 36 via a belt 46. Alternatively, the present invention could be employed in an automatic washer which employs a direct drive type power transmission system.

Alternatively, the rotor of the automatic washer 30 can comprise an agitator instead of the impeller 40.

During periods of the automatic washer operation, water is supplied into the automatic washer 30 from an external source 50. Preferably, both a hot water and cold water supply is fluidly connected to the automatic washer 30. A flow valve 52, controls the inlet of wash liquid into the washer 30. Wash liquid is sprayed into the wash basket 42 through an inlet nozzle 54. A controller 60 controls the operation of the washer in accordance with the present invention. Controller 60 is operatively connected to the motor 44 and the flow valve 52. Controller 60 provides an oscillation signal (e.g., an on/off or variable speed signal) to the motor 44 for inducing the impeller 40 to rotate.

Figure 3:
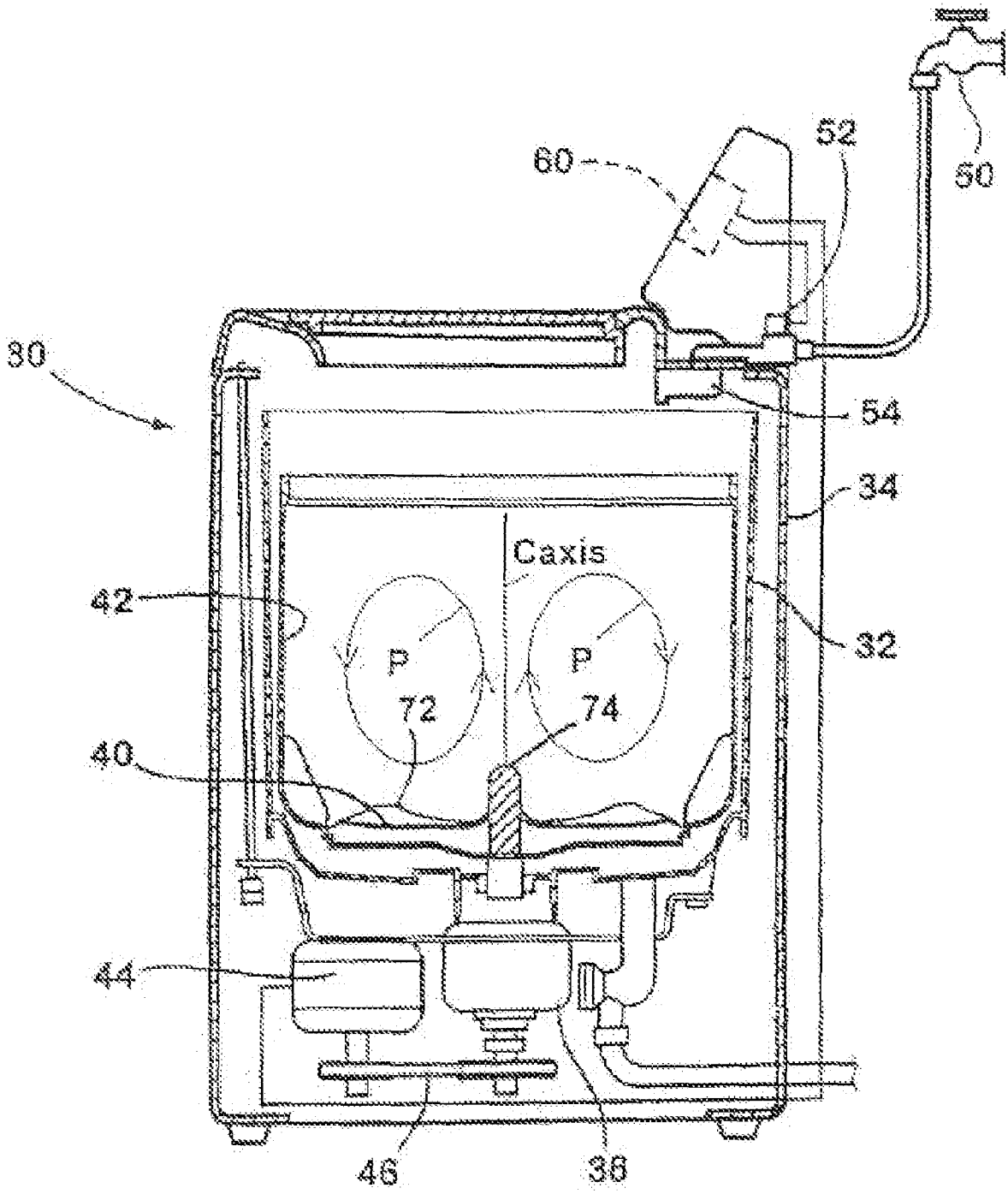
FIG. 3 depicts a side sectional view of the washing machine of FIG. 2 schematically illustrating the movement of items within the washing machine in accordance with the present invention.

FIG. 3, when considered in combination with FIG. 2, provides a schematic illustration that is useful for explaining the movement of items within the automatic washer 30. Items, such as clothes, are loaded into the wash basket 42 by a user up to a desired item level. Water is supplied into the wash basket 42 up to a level that preferably exceeds the clothes level. In operation, the impeller 40 is oscillated according to oscillation signals provided by the controller 60. When the impeller 40 is oscillated, the items within the wash basket 42 move along an item motion path. In FIG. 3, the item motion path is indicated by arrows P. As illustrated, the item motion path P is a pattern that provides rollover of the items within the wash basket 42 down a side wall of the wash basket 42, radially inward along the impeller 40, upward along the center axis $C_{axis}$ of the impeller 40, and then radially outward at the upper portion of the item load. The depicted item motion path P exhibits inverse toroidal motion, however, the present invention is not limited thereto. The present invention can, for example, be embodied in a washing machine that provides non-inverse toroidal motion.

As used herein, the term oscillate as related to rotor (e.g., impeller or agitator 40) motion describes rotor motion wherein the rotor is alternately rotated in a first direction and then in a reverse direction. The rotor may complete many full revolutions while rotating or spinning in one direction before being reversed to rotate in the opposite direction. The rotation or spinning of the rotor in any particular direction may be referred to as a stroke such that the oscillation of the rotor involves a stroke in a first direction (e.g., clockwise) followed by a stroke in a second direction (e.g., counter-clockwise) repeated a plurality of times. Each stroke may include rotating the rotor through many complete revolutions or less than a full revolution.

In accordance with methods and apparatuses consistent with the present invention, the mechanical action inside the automatic washer 30 is enhanced by using symmetric clockwise and counter-clockwise impeller or agitator oscillations that vary randomly with each subsequent oscillation period. As described above, these oscillations that vary randomly with each subsequent period are referred to herein as "random strokes". Further, as will be described in more detail below, in an embodiment, the variation of the oscillations can be bi-modal, that is, limited to two selected period lengths, switching between these two lengths after every third or more period.

Figure 4:
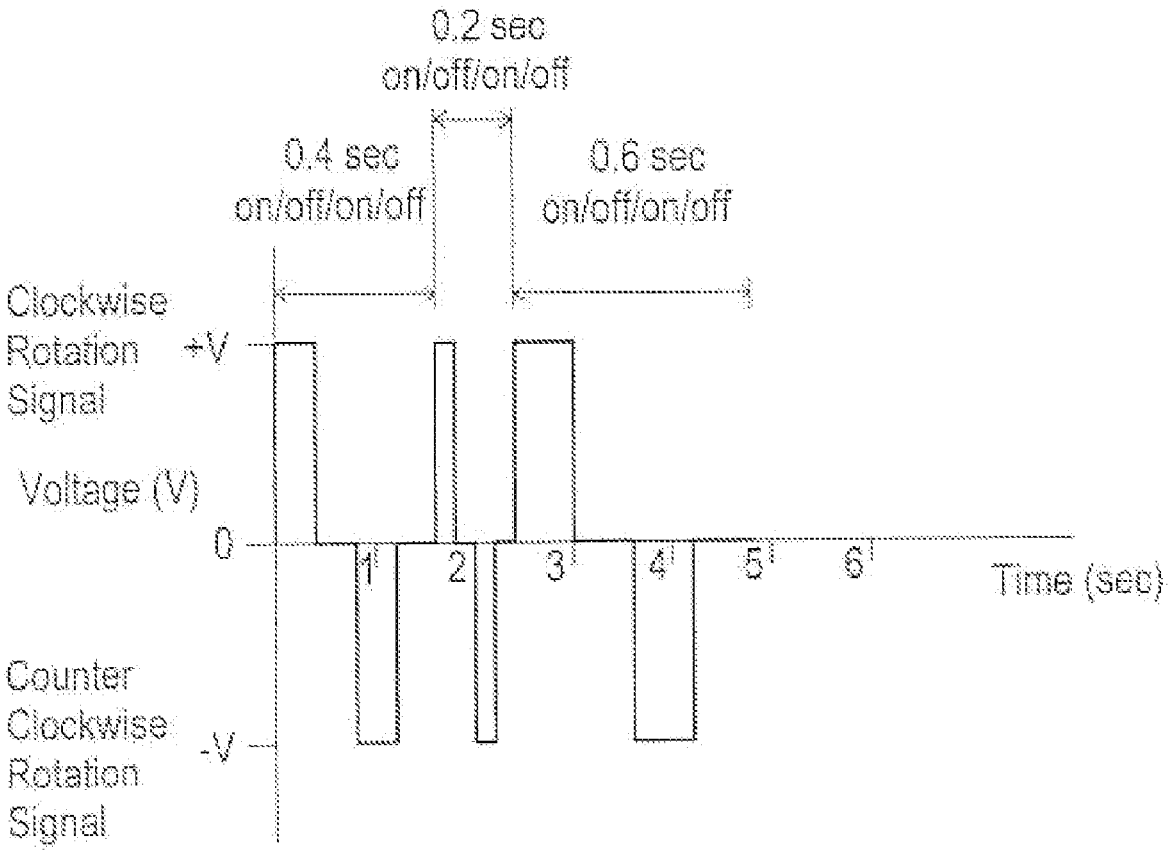
FIG. 4 depicts a timing diagram of symmetrical motor oscillations that vary with each subsequent period in accordance with the present invention.

FIG. 4 depicts symmetrical motor oscillations that vary with each subsequent period in accordance with the present invention. As shown in FIG. 4, the first random impeller oscillation time is 0.4 seconds. This value is used during one oscillation period: 0.4 seconds clockwise (motor on) time, 0.4 seconds pause (motor off), 0.4 seconds counter-clockwise (motor on) time, and 0.4 seconds pause (motor off). Once the period is complete, a second "random" value, which may be different than the first random value of 0.4 seconds, is used. In the illustrative example, 0.2 seconds is used for the next oscillation period. Once this second oscillation period is complete, a value of 0.6 seconds is used for the next oscillation period. In the illustrative example depicted in FIG. 4, the impeller oscillation times range from 0.2 to 0.6 seconds. The oscillation times can be set to a greater number of discrete values than shown in FIG. 4. Also, other oscillation times in the range from 0.2 to 0.6 seconds can be used, such as oscillation times of 0.222 and 0.369 seconds. Randomly varying the oscillation time between the limits, with each subsequent period, yields a distribution of oscillation times.

In the illustrative example of FIG. 4, the impeller oscillation times range from 0.2 to 0.6 seconds, however, the upper and lower oscillation time limits are not limited thereto. The oscillations times can be lower than 0.2 seconds and can be greater than 0.6 seconds.

Figure 5:
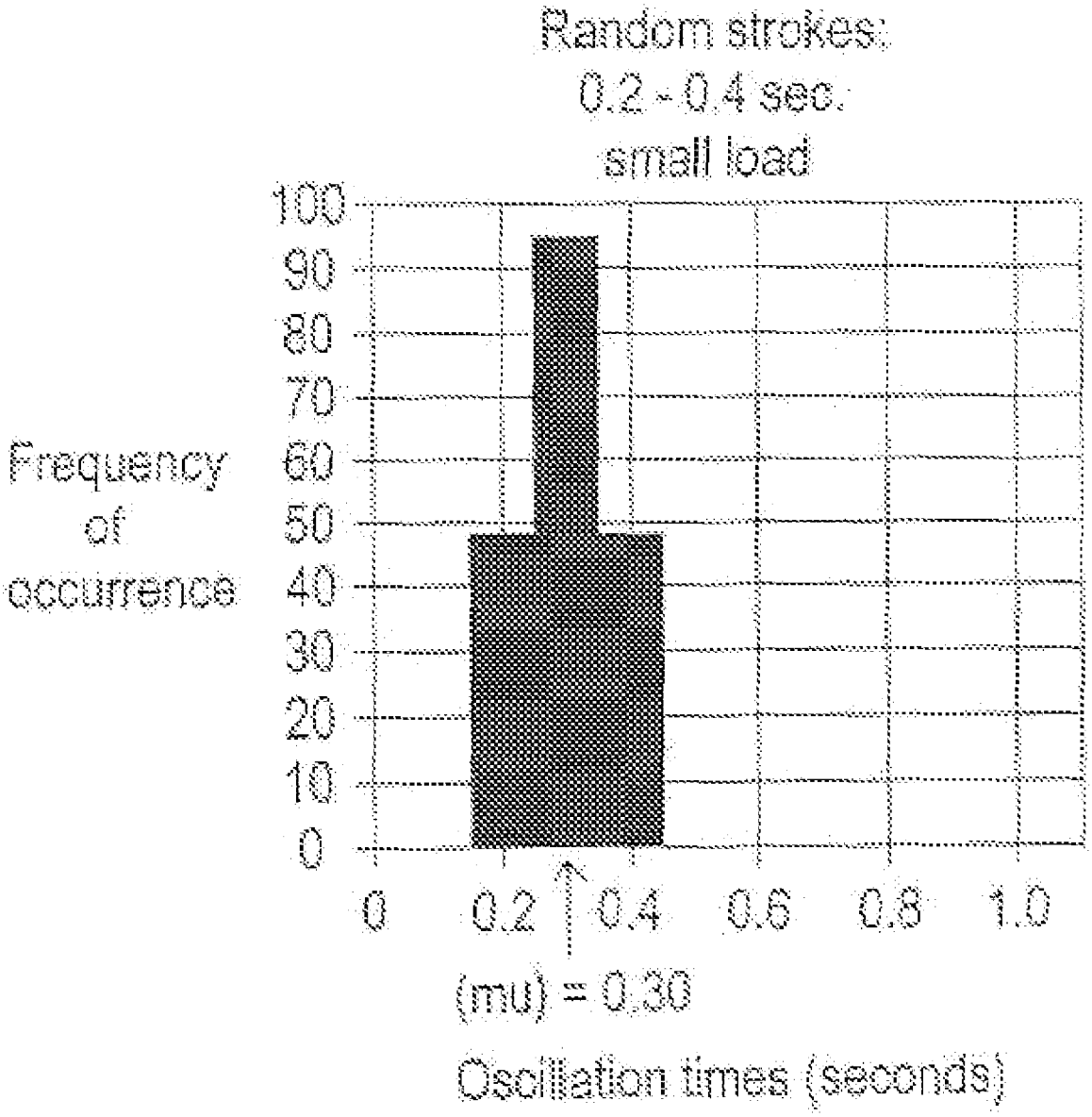
FIG. 5 depicts a histogram of an example relative number of instances that a discrete oscillation time occurs for a small load in accordance with the present invention.
Figure 6:
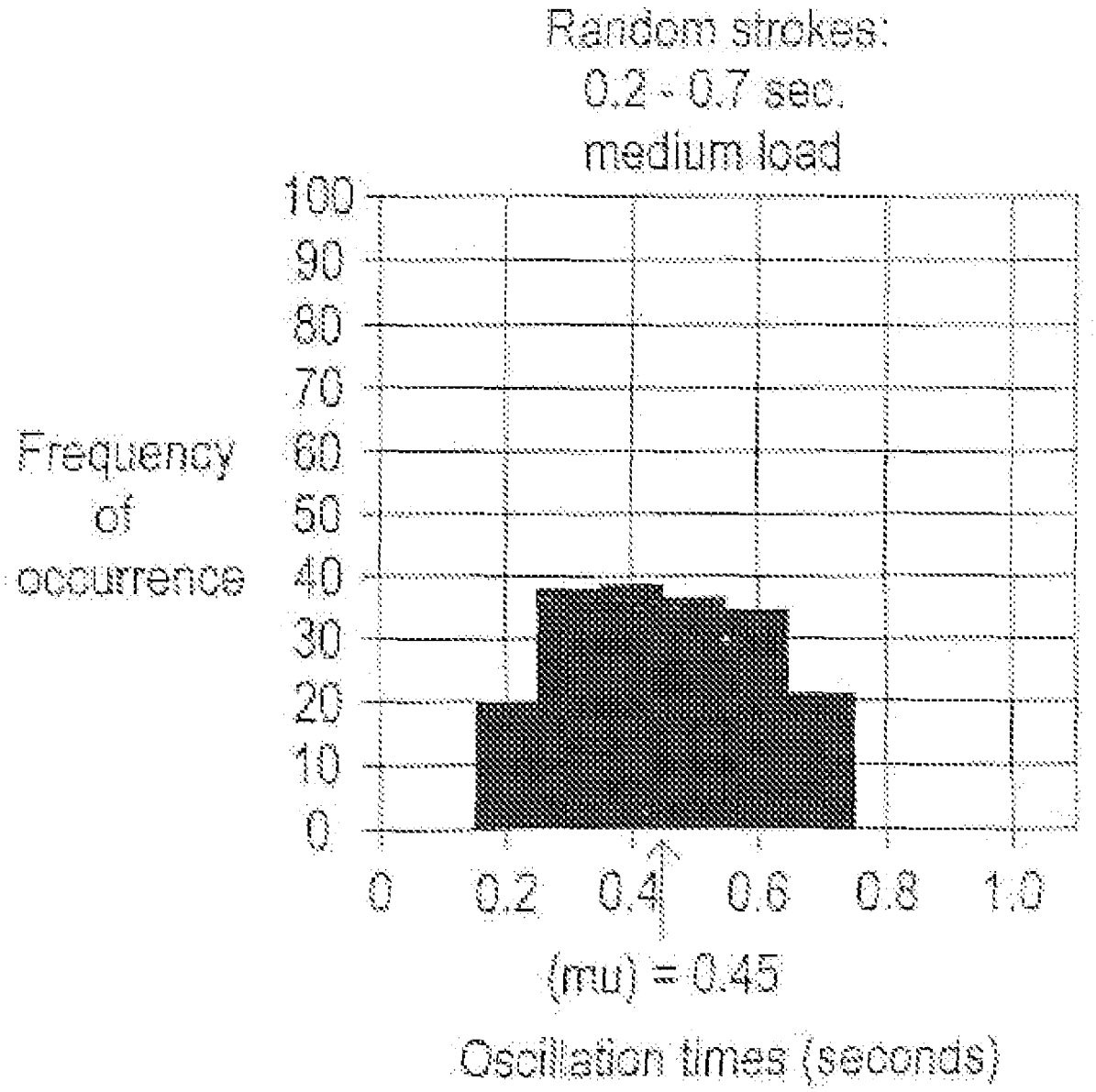
FIG. 6 depicts a histogram of an example relative number of instances that a discrete oscillation time occurs for a medium load in accordance with the present invention.
Figure 7:
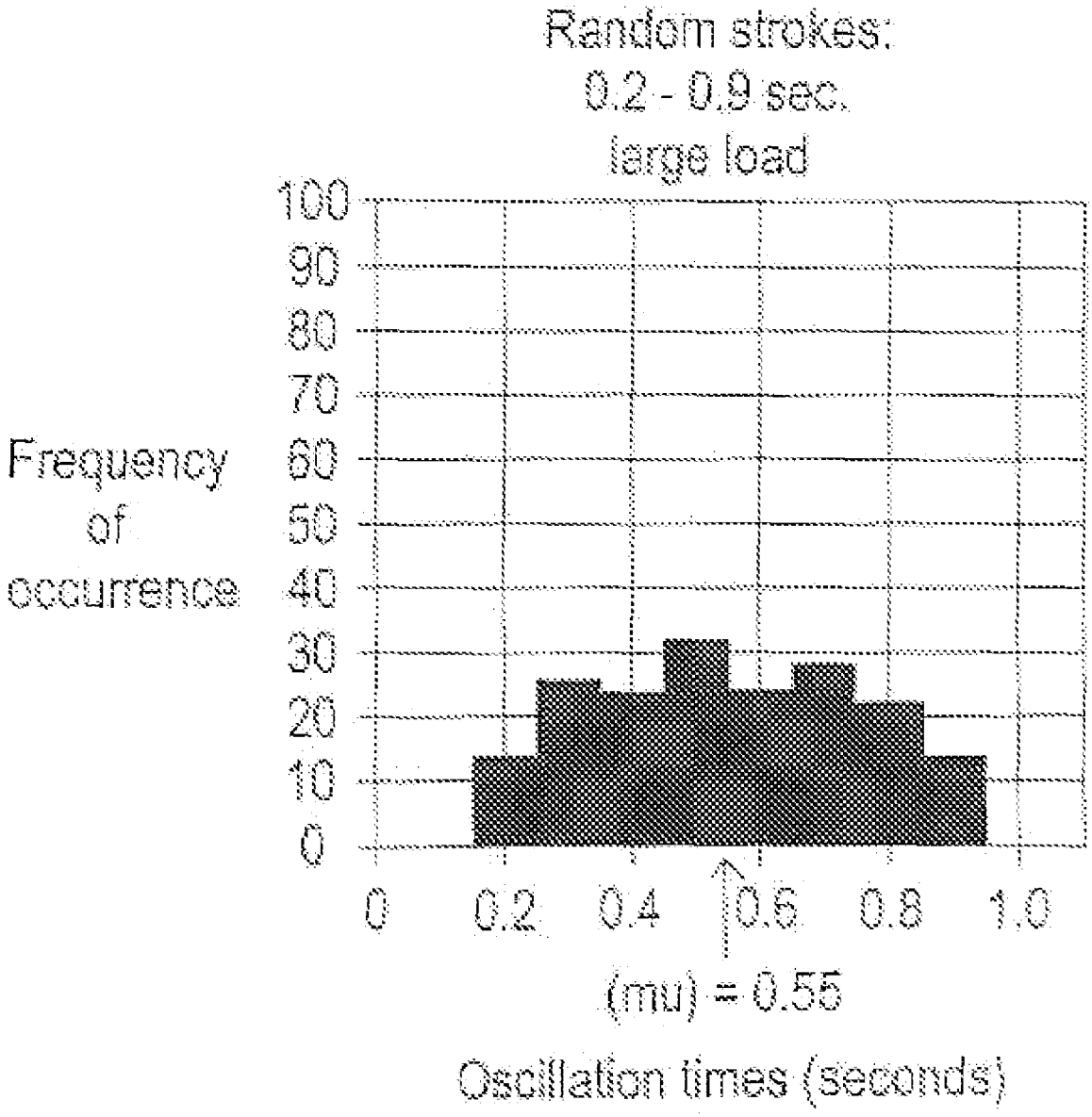
FIG. 7 depicts a histogram of an example relative number of instances that a discrete oscillation time occurs for a large load in accordance with the present invention.

In illustrative examples consistent with the present invention, three oscillating time distributions are depicted in FIGS. 5, 6, and 7 that illustrate the improved item rollover of the present invention compared to symmetrical motor oscillations that are constant for all periods. The data presented in FIGS. 5, 6, and 7 is based on experimental test data obtained by the applicants. In the experiments, test loads were moved in an inverse toroidal impeller washing machine, using an eight-gallon total water fill. Small (1 Kg), medium (3 Kg), and large (5 Kg) clothes loads were found to move well in the washing machine, using oscillation times that ranged between 0.2 and 0.4 seconds, 0.2 and 0.7 seconds, and 0.2 and 0.9 seconds, respectively. Histograms for the small, medium, and large load sizes are depicted in FIGS. 5, 6, and 7, respectively, with the oscillation times noted for the small, medium, and large load sizes. These histograms show the relative number of instances that a discrete oscillation time, located in each column, could occur. This relative instance is shown by the frequency of occurrence axis labeled 0 to 100.

The average, or mean (μ) value for each of the distributions is also shown for each histogram. Examination of the mean oscillation time values shows that as the load size increases from small to large, the average oscillation time increases (mean shifts right). This increase in oscillation time represents an increase in the average power transmitted to the load as load size increases. This matching of input power to load size is appropriate, given that heavier, denser loads require more power to move the load, whereas lighter, looser loads do not require the higher power level and may become tangled or "bunched" if the power is too high. However, the distribution of oscillations also acts to provide other advantages.

The range of oscillation times is depicted to become wider as the load size increases. This larger variation of the oscillation time, as opposed to a fixed oscillation time, increases the probability that discrete elements found in heavier, complex loads will be matched to discrete oscillation times. As an example, consider a larger size load that has a greater chance of containing diverse size load items, such as, a shoe and a small handkerchief. The oscillation times best suited to move the shoe would be longer, representing a higher power transmitted to the whole load. However, a large series of longer oscillation times are not best suited for the handkerchief, and may tangle the handkerchief or tangle a group of handkerchiefs together.

The present invention overcomes this problem by avoiding a large series of identical, longer oscillation times. Instead, when a larger and presumed complex load is anticipated, the variation of oscillation times is increased, but the average oscillation time is kept relatively long. This variation increases the probability that both the shoe and the handkerchief will be acted upon by individual oscillation times that cause them to move and "rollover" in the washer. As a further advantage, the present invention does not "over-power" the handkerchief with a continuous long oscillation time or "under-power" the shoe with an average short oscillation time.

The time-varying rotor oscillations of the present invention are applicable to all large loads, including those that do not appear to be as "disparate" as the handkerchief-and-shoe load of the above-described example. For example, the present invention can be applied to more uniform load items, such as a large size load containing similar load items, like towels. Given a large number of towels (e.g., 10 to 20) in a large size load, there is a probability that due to mechanical interaction between load items, one or more towels may become tightly wrapped onto itself or tangled with another towel. Similarly, one or more towels in the same load are expected to remain flat and uncoupled to other towels. The tightly wrapped item is analogous to the shoe and the flat towel is analogous to the handkerchief, with a "disparity" between them. The present invention inventively improves rollover of this load through time-varying rotor oscillations.

As seen in the histograms of FIGS. 5–7, the range of oscillation times is greater for large loads and reduced for small loads. When considering smaller and reduced item load sizes, there is less need for variation, as the probability of "disparity" between load items is reduced as the number of load items is reduced. However, the use of variation with small loads is still desirable, as observation of small loads (1 Kg) in a low-water impeller washer has shown that fixed oscillation times can lead to "bunching" of the load into one quadrant of the washing machine. The tendency for "bunching" is reduced when variable oscillation times, centered on lower average mean times, are used. Observation has also shown that a moderately "bunched" clothes mass can be "un-bunched" or redistributed through the wash basket quadrants, by changing from a fixed stroke pattern to a variable stroke pattern in accordance with the present invention.

Thus, the controller 60 can receive an input from a user to adjust the oscillation time based on, for example, the amount of the items, the size of the items, or the type of items in the load. The controller is provided with, for example, a keypad or operators for this purpose. Using the keypad, the user, for example, selects a small, medium, or large load size or a small, medium, or large item size. The controller 60 can proportionally adjust the oscillation time based on the received user input, such as proportionally to load size or item size. Alternatively, the controller 60 can increase or decrease the variation of the oscillation time based on the load size or item size. For example, the controller 60 can provide oscillation signals having lower average means times for small loads than for large loads.

The small, medium, and large load distributions described with reference to FIGS. 5–7 are "normal distributions" in the statistical sense, in that they are symmetric about a mean oscillation time. However, the present invention is not limited to using those distributions, and can use other types of distributions to obtain the similar advantages. For example, in an embodiment, the present invention can be implemented using a "bi-modal" distribution.

Figure 8:
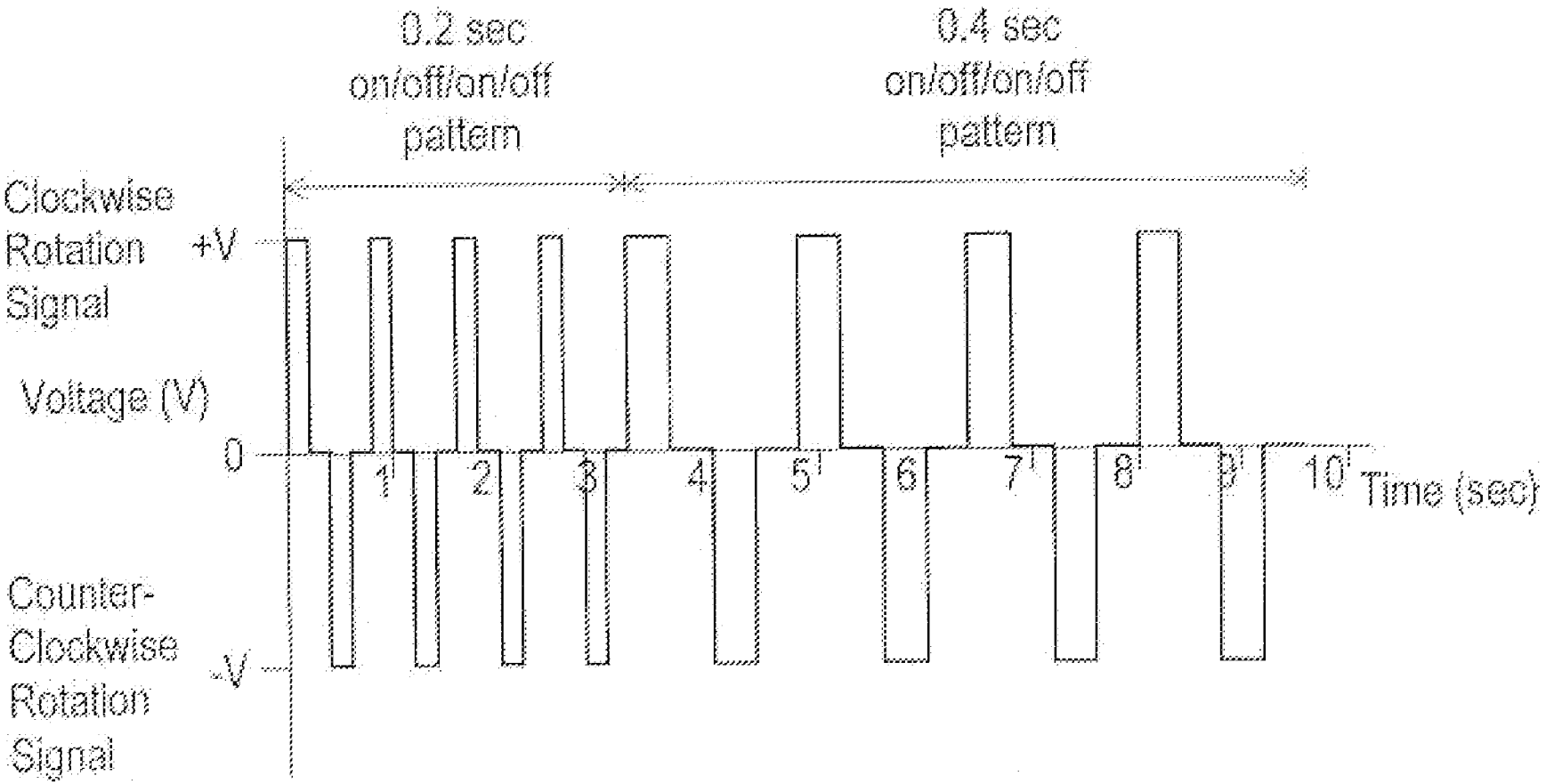
FIG. 8 depicts a timing diagram of symmetrical motor oscillations that vary every fourth period in accordance with the present invention.

FIG. 8 depicts a timing diagram of an illustrative "bi-modal stroke" profile. In a "bi-modal stroke" profile, symmetrical impeller oscillations having a first time value (e.g., 0.2 seconds) repeat for a first predetermined number of oscillation periods (e.g., 4 oscillation periods), then symmetrical impeller oscillations having a different time value (e.g., 0.4 seconds) repeat for a second predetermined number of oscillation periods (e.g., 6 oscillation periods), then the entire impeller oscillation sequence is repeated. As shown in FIG. 8, the illustrative values are 0.2-second impeller oscillations, repeated for a total of four oscillation periods, followed by 0.4-second impeller oscillations, repeated for a total of four oscillation periods. The entire impeller oscillation sequence is then repeated. Alternatively, the duration of the oscillations and the number of periods used can be different values. For example, the first oscillation time value can be 0.211 seconds, with the oscillations repeating for three periods, followed by a 0.455-second oscillation for seven periods.

While the above-described embodiments of the present invention are presented in terms of symmetric on/pause/on/pause oscillation patterns, the present invention is not limited thereto. The present invention can be implemented with asymmetric oscillation patterns as well. For example, the present invention can be implemented with "random" clockwise and counter-clockwise oscillations with constant motor off times, with "random" clockwise and counter-clockwise oscillations with "random" motor off times, or with constant clockwise and counter-clockwise oscillations with "random" motor off times.

Further, one of skill in the art will appreciate that the present invention can be implemented in washing machines having an agitator, horizontal axis drum, or tilted axis drum design instead of an impeller, as well as other appliances that have oscillating components.

Experimental Test Results

Figure 9:
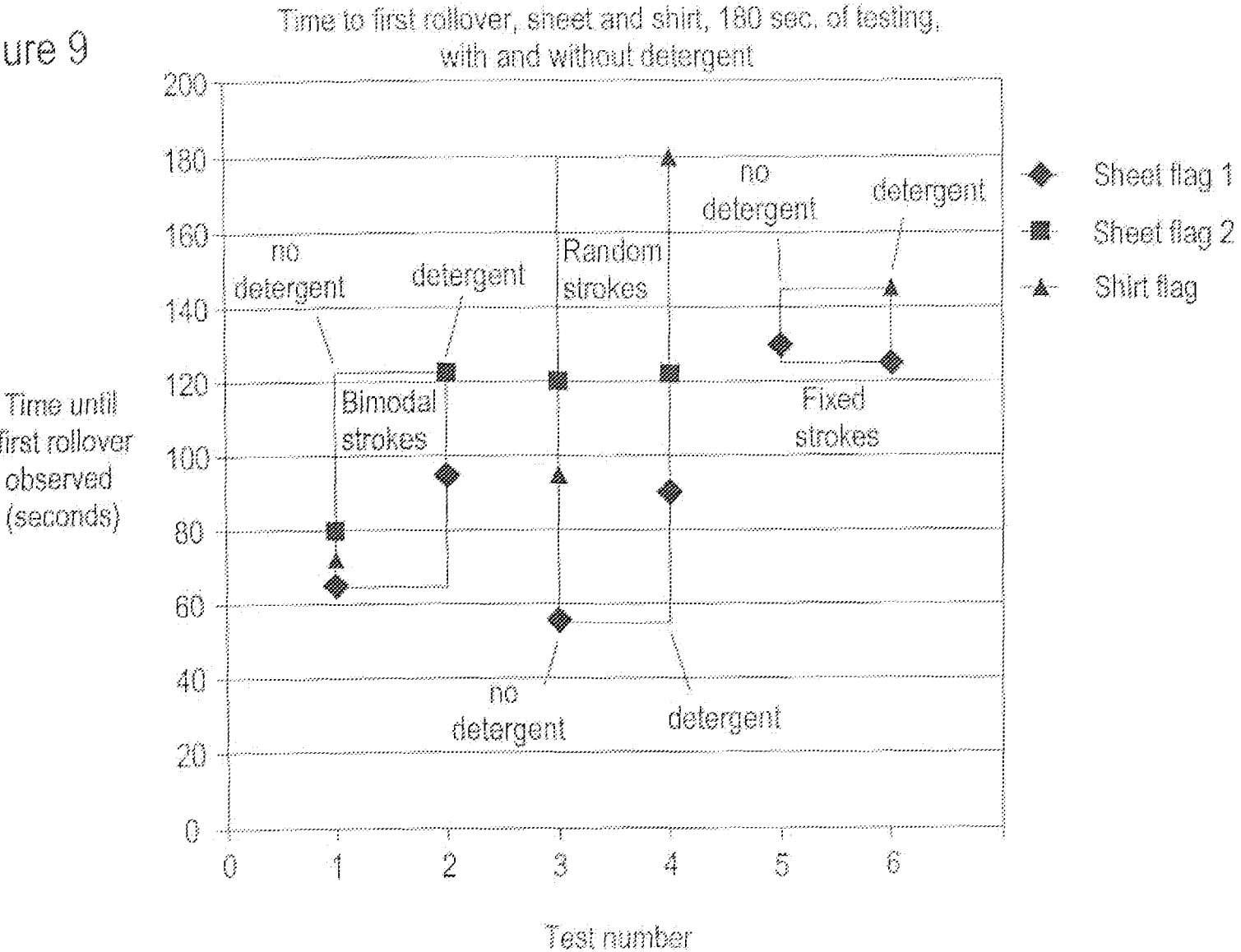
FIG. 9 illustrates experimental results of the time to first observance of rollover of sheet and shirt items, with and without detergent, in a washing machine.
Figure 10:
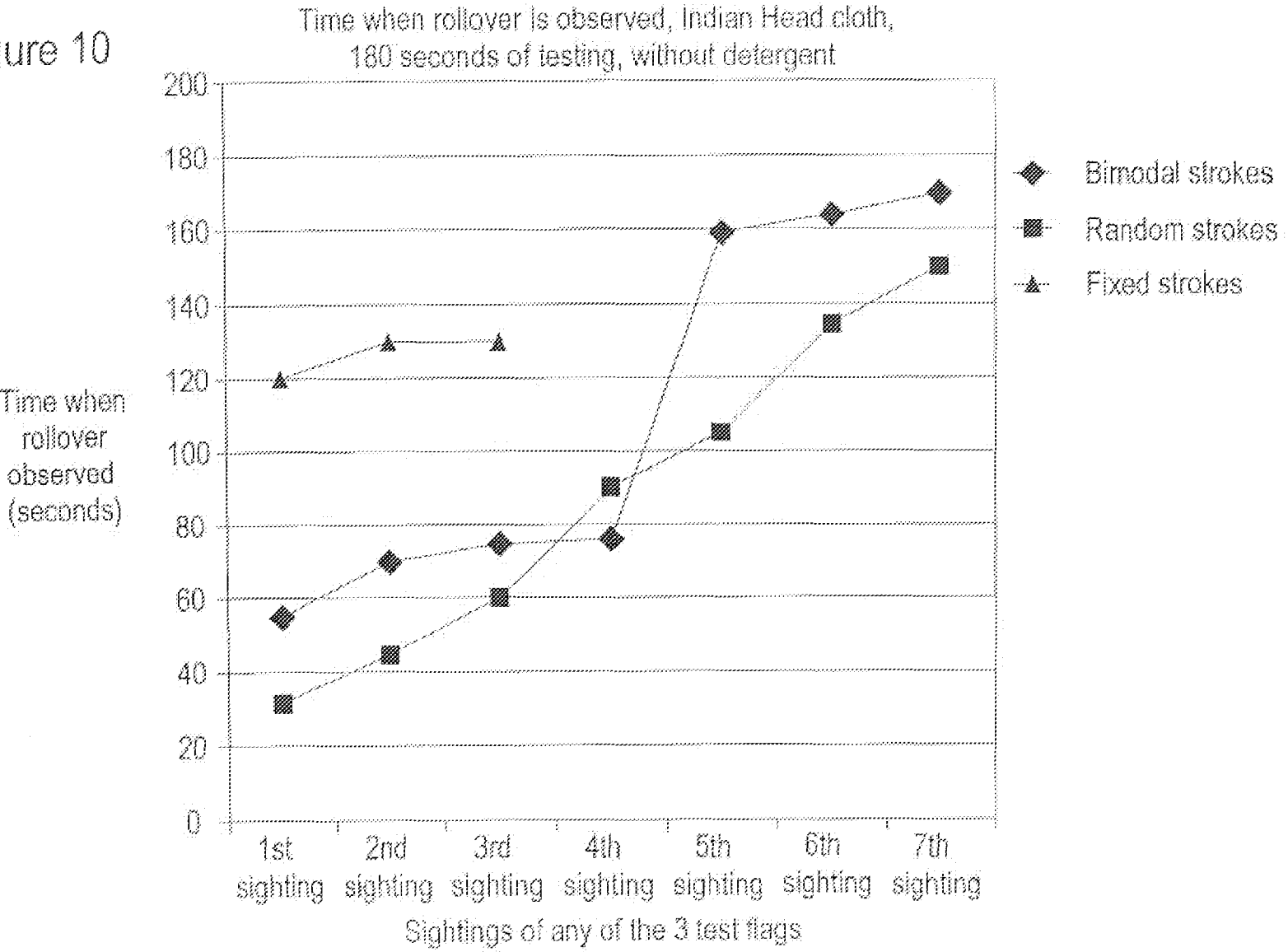
FIG. 10 illustrates experimental results of the time to first observance of rollover of Indian Head cloth items, without detergent, in a washing machine.
Figure 11:
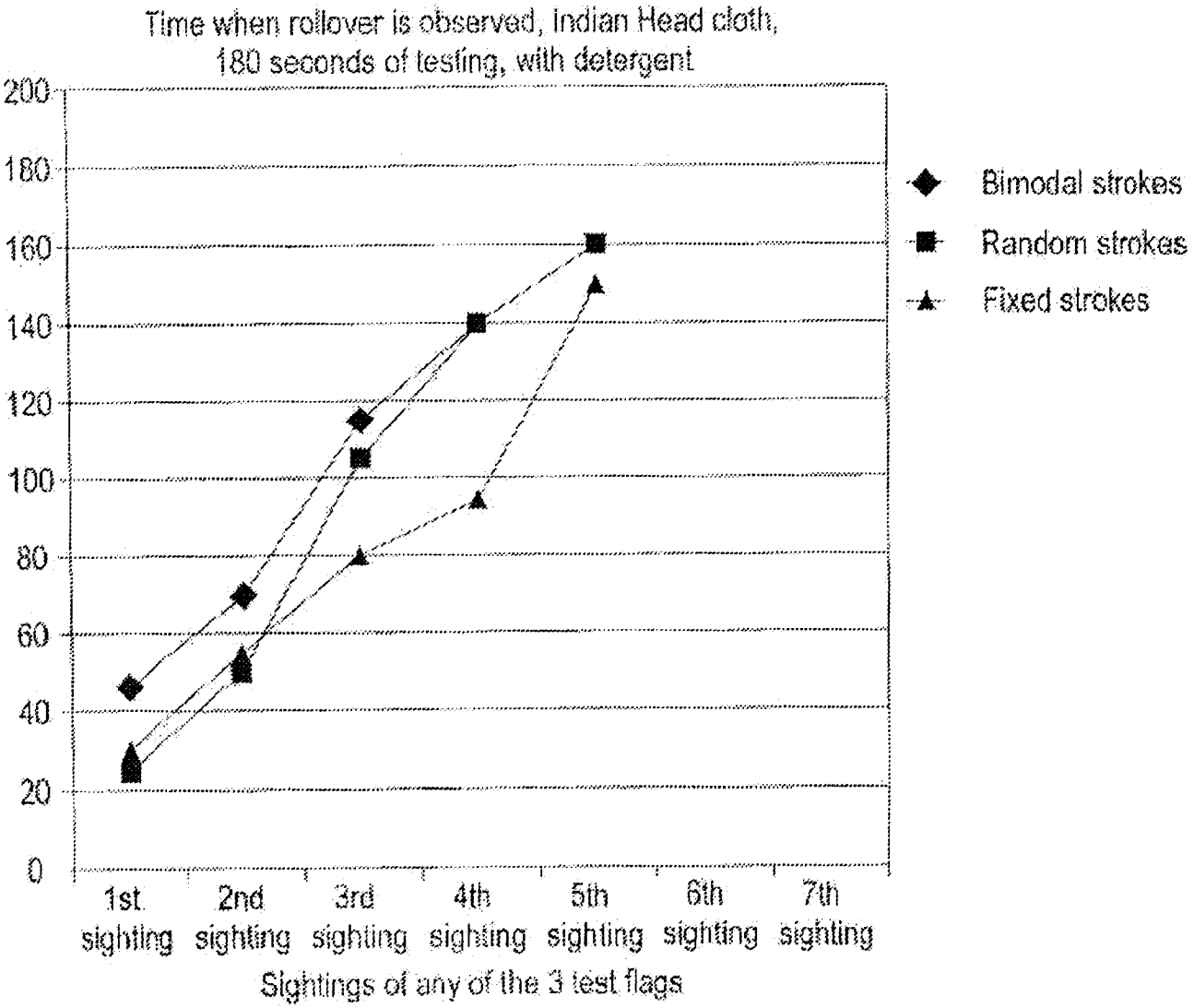
FIG. 11 illustrates experimental results of the time to first observance of rollover of Indian Head cloth items, with detergent, in a washing machine.

Experimental test results illustrating the enhanced "rollover" potential of the "random strokes" and "bi-modal strokes" oscillation profiles of the present invention are depicted in FIGS. 9, 10, and 11, with performance comparison to a typical "fixed stroke" oscillation profile. Testing involved placing a 1 Kg test load in an impeller-type washing machine, saturating the load with 8 gallons of water at 100° F., and setting the load into an untangled pattern by "pre-agitating" the load for approximately one minute. After "pre-agitating" the load, 3"×3" test swatches were attached to a top-most layer of the load. The "rollover" behavior of the swatches was observed for 180 seconds, as the impeller action pulled the swatches in an inverse toroidal pattern, i.e., radially outward across the load top, down the wash basket sides, radially inward along the impeller, and presented them back up to the center of the washer. In the "random strokes" oscillation profile samples, impeller oscillation was time varied between 0.2 and 0.4 seconds. In the "bi-modal strokes" oscillation samples, impeller oscillation times of 0.2 and 0.4 seconds were used. In the "fixed strokes" oscillation profile, impeller oscillation was set at 0.5 seconds.

Two metrics were recorded in separate tests:

Test 1) Time to the first "rollover", i.e., time to when an individual swatch was first presented at the washer center. The initial speed to start the "rollover" can be inferred from this test.

Test 2) Times when "rollover" was observed, i.e., times when a swatch surfaced at the washer center, without recording which individual swatch was observed. The continuity of the "rollover" motion can be inferred from this test.

Factors such as detergent (detergent vs. water only) and load type (Indian Head cloth vs. sheet & shirt) were also tested.

The results of Test 1 are depicted in FIG. 9. As illustrated in FIG. 9, show that the "random strokes" and "bi-modal strokes" oscillation profiles, on average, start their "rollover" pattern sooner, when compared with the "fixed strokes" oscillation profile. The slower "rollover" pattern was also seen when using shorter duration "fixed strokes" of 0.3 seconds (not plotted). Detergent made the "rollover" patterns more variable.

The results of Test 2 are depicted in FIGS. 10 and 11. As illustrated in FIG. 10, the results show that, without detergent, "random strokes" and "bimodal strokes" oscillation profiles produce a quicker and continual "rollover" pattern, whereas the "rollover" provided by the "fixed strokes" oscillation profile starts later and ends prematurely, due to uneven distribution of "bunching". As illustrated in FIG. 11, repeat testing with detergent shows that all tested distributions start at roughly the same time, but the tendency of the "fixed strokes" to produce a "bunching" is still apparent.

Recirculating spray systems were used in some of the tests.

In accordance with methods and apparatuses consistent with the present invention, improved clothes "rollover" in clothes washers is provided by time-varying impeller or agitator oscillation profiles. The use of distributions of agitator or impeller oscillation times allows a shift of the mean value and an expansion of the range of values as is suited to the load. The present invention can be used to move heavy, complex loads and to avoid the problems of tangling and "bunching" in large and small loads. Further, the present invention may be implemented in other oscillating systems in appliances.

The foregoing description of an implementation of the invention has been presented for purposes of illustration and description. It is not exhaustive and does not limit the invention to the precise form disclosed. Modifications and variations are possible in light of the above teachings or may be acquired from practicing the invention. The scope of the invention is defined by the claims and their equivalents.

We claim:

1. An automatic washer, comprising:

a cabinet;

a wash chamber with a vertical central axis supported within the cabinet;

a motor mounted outside the wash chamber;

a rotor disposed in the wash chamber and drivingly connected to the motor, the rotor oscillating about the central axis by time-varying oscillations; and a controller configured to oscillate the rotor for a plurality of periods having at least one clockwise oscillation and at least one counter-clockwise oscillation, a time duration of the oscillations selected for each period and the time durations for each of the periods being randomly selected.

2. The automatic washer of claim 1, wherein the rotor is an agitator.

3. An automatic washer of claim 1, wherein the rotor is an impeller.

4. The automatic washer of claim 1, wherein the rotor is a tilted axis drum.

5. An automatic washer having a wash chamber with a vertical central axis rotatable about the vertical central axis, the automatic washer comprising:

means for loading items into the wash chamber;

means for supplying wash liquid into the wash chamber;

means for oscillating the rotor about the vertical central axis by time-varying oscillations; and a controller configured to oscillate the rotor for a plurality of periods having at least one clockwise oscillation and at least one counter-clockwise oscillation, a time duration of the oscillations varying for consecutive periods and the time durations for each of the periods being randomly selected.

6. The automatic washer of claim 5, wherein the rotor is an agitator.

7. The automatic washer of claim 5, wherein the rotor is an impeller.

8. The automatic washer of claim 5, wherein the rotor is a tilted axis drum.

9. The automatic washer of claim 5, wherein the oscillations are symmetric.

10. The automatic washer of claim 5, wherein the oscillations are asymmetric.

11. The automatic washer of claim 10, wherein the time duration comprises a first time duration of the clockwise oscillation and a second time duration of the counter-clockwise oscillation, the first time duration being different than the second time duration.

12. The automatic washer of claim 5, wherein the oscillations comprise a motor on time and a motor off time, and wherein the time durations of the motor on times are selected for each period.

13. The automatic washer of claim 5, wherein the oscillations comprise a motor on time and a motor off time, and wherein the time durations of the motor off times are selected for each period.

14. The automatic washer of claim 5, wherein the controller is further configured to perform the step of:

adjusting an average mean time of the time-varying oscillations responsive to an amount of the items.

15. The automatic washer of claim 5, wherein the controller is further configured to perform the step of:

adjusting an average mean time of the time-varying oscillations responsive to a size of the items.

16. The automatic washer of claim 5, wherein the controller is further configured to perform the step of:

adjusting an average mean time of the time-varying oscillations responsive to a type of the items.

17. The automatic washer of claim 5, wherein the items move along an inverse toroidal rollover path in the wash chamber.

18. The automatic washer of claim 5, wherein the items move along a non-inverse toroidal path in the wash chamber.

19. The automatic washer of claim 5, wherein the means for supplying wash liquid into the wash chamber includes a wash liquid supply fluidly connected to the wash chamber and a flow valve for controlling a flow of wash liquid from the wash liquid supply into the wash chamber, the flow valve being controlled by the controller.

20. The automatic washer of claim 5, wherein the means for oscillating the rotor includes a reversible motor mechanically coupled to the rotor and controlled by the controller.

* * * * *